US005813729A

United States Patent [19]

Lewis, Jr.

[11] Patent Number: 5,813,729

[45] Date of Patent: Sep. 29, 1998

[54] BLOW-MOLDED BRUSHWARE AND METHOD OF FUSING THE SAME

[75] Inventor: John C. Lewis, Jr., Salisbury, Vt.

[73] Assignee: Tucel Industries, Inc., Forestdale, Vt.

[21] Appl. No.: 816,034

[22] Filed: Mar. 11, 1997

[51] Int. Cl.[6] ..... A46D 1/08; A46D 3/00

[52] U.S. Cl. ..... 300/21; 15/193; 15/186; 15/159.1

[58] Field of Search ..... 15/186, 187, 188, 15/190, 207.2, 193, 192, 160, 159.1; 300/21

[56] References Cited

U.S. PATENT DOCUMENTS

| | | | |
|---|---|---|---|
| 3,604,043 | 9/1971 | Lewis | 15/192 |
| 4,189,189 | 2/1980 | Lewis | 300/21 |
| 4,291,431 | 9/1981 | Lewis | 300/21 |
| 4,348,060 | 9/1982 | Lewis | 300/21 |
| 4,637,660 | 1/1987 | Weihrouch | 300/21 |
| 4,690,277 | 9/1987 | Lewis | 15/167.1 |
| 4,693,519 | 9/1987 | Lewis | 300/7 |
| 5,349,715 | 9/1994 | Lewis, Jr. | 15/187 |

FOREIGN PATENT DOCUMENTS

| | | | |
|---|---|---|---|
| 278315 | 4/1928 | United Kingdom | 300/21 |

*Primary Examiner*—Gary K. Graham
*Attorney, Agent, or Firm*—Donald C. Casey, Esq.

[57] ABSTRACT

A method for fusing brushware on a thin walled, molded hollow plastic synthetic container is described. Tufts of synthetic materials are picked and non-working ends thereof fused. The hollow bottle is molded with protrusions extending from a surface thereof with one protrusion intended to received each fused tuft end. The protrusions then are heat softened to form a melted section of synthetic surface wherein the fused tuft end can be mounted. The result is a hollow container having tufts extending from the outer surface thereof, integral with the container without distorting the thin wall thereof by the fusing process.

10 Claims, 3 Drawing Sheets

BLOW-MOLDED BRUSHWARE AND METHOD OF FUSING THE SAME

CROSS REFERENCE TO RELATED APPLICATIONS

This application is related to my co-pending patent application Ser. No. 08/540,504, filed Oct. 10, 1995, which was a division of application Ser. No. 08/198,704, filed Feb. 18, 1994, now abandoned, which was a continuation-in-part of application Ser. No. 08/137,537, filed Oct. 18, 1993, now U.S. Pat. No. 5,511,274.

BACKGROUND

1. Field of the Invention

This invention relates to fused, tufted constructions wherein synthetic filament tufts are fused at a non-working end and integrally attached to a base. In particular this invention relates to an article and method of preparation wherein said tufted constructions are formed of relatively thin walled hollow articles wherein the walls are subject to deformation by the heat of fusing.

2. Description of the Prior Art

Many different types of brushware articles and methods for their manufacture have been described in the prior art. Traditionally, brushware constructions have tufts which are wire-set, anchor-set, staple-set, twisted in wire, and resin set, and include both natural and synthetic filament tufts. The method of preparing tufted constructions wherein synthetic filament tufts are fused onto a synthetic support, and articles using such techniques are described in my of my U.S. patents, assigned to the assignee of this invention. For example, U.S. Pat. Nos. 3,604,043; 4,189,189; 4,291,431; 4,348,060; 4,690,277 and 4,693,519 are exemplary and are hereby incorporated by reference. These patents disclose tufted fused brush and mat like devices wherein synthetic filament tufts are fused to molded base sections of synthetic material.

In my co-pending patent application Ser. No. 08/540,504, filed Oct. 10, 1995, there is described the preparation of a tufted construction wherein the material of the base or brush block when heated, deforms and warps when cooling. The process wherein a heated brush block receives a fused tuft end for mounting then without more, produces a warped working surface for the tufted construction. That application describes pre-configuring the brush block to take into consideration the fact that it deforms when it heats, and warps when it cools so that the resulting article is a tufted construction wherein the working ends of the tufts lie in a predetermined configuration to maximize the scrubbing power so that all tuft ends encounter a surface to be cleaned simultaneously.

As noted in that application the fusing process causes an originally flat brushware block to take a first curvature when heated and upon cooling causes the block to warp beyond that original profile to a second curvature without outside intervention. Obviously, a warped brush block would not be desirable in that it would require a trimming step for the working ends of the filament tufts or, a second heating action on the opposite side of the brush block in a attempt to cause it to reorient its molecular structure. This latter procedure could produce the desired article without trimming. These procedures however are not available when tufts are fused onto a relatively thin walled surface such as containers prepared by conventional blow-molding techniques.

SUMMARY OF THE INVENTION

It has been discovered, however, that thin walled hollow containers can have fused tufts attached to the outer surface thereof wherein the outer surface retains its original configuration according to the process of this invention. Specifically, the container is formed with conical protrusions on the outer surface thereof oriented and aligned in the place desired for each tuft. Each protrusion is then heated and a fused tuft end mounted thereon. In the case of a blow molded bottle or the like, the procedure of the invention is application to a bottle having a wall thickness from about 0.020 inches to 0.050 inches so long as the ratio of the height of the raised portion to its width is at least about 0.5.

The improved process of this invention includes the steps of providing a base which is a hollow thin wall construction having outward protrusions thereon configured in the design desired for the tufted construction, picking the tufts to form the tufted construction, fusing the non-working ends of said tufts, orienting said tufts one adjacent each of said protrusions, fusing the protrusions, and mounting the fused ends of the tufts on the fused protrusions whereby when the article cools a tufted blow-molded construction will be provided.

Accordingly it is the object of this invention to provide a thin-walled, blow-molded integral one-piece fused filament/block cleaning device or brushware device wherein the resulting filament working ends are supported by the blow-molded construction.

It another object of the instant invention to provide a one component recyclable, non-polluting brushware construction wherein in the base is a thin-walled container having integral tufts mounted on at least one surface thereof.

It a further object of this invention to provide a tufted construction wherein a container portion is provided for loading liquid therein, and integral tufts extend from a surface thereof so that when the liquid is poured on the surface the container becomes a tufted construction for working the liquid into the surface.

It another object of this invention to provide method for manufacturing brushware articles including a thin-walled hollow container for dispensing liquid or dry material having integral fused tufts extending from at least a portion of the outer surface thereof.

These and other objects will become readily apparent with reference to the drawings and following descriptions wherein:

DETAILED DESCRIPTION OF THE INVENTION

Definitions

The term "brushware" as used herein includes any device having a synthetic base with synthetic filament tufts thereon, including a base of synthetic material that is hollow, thin-walled and further including such a base which is blow molded. The base can include a hand placement area, a handle, or a bracket or similar device for attaching a handle.

The term "synthetic" as in synthetic filament used herein include filaments which are formed from linear thermoplastic polymers from the group consisting of polystyrene and polystyrene co-polymers, polyvinyl chloride and polyvinyl chloride-acetate co-polymers, polyethylene, polypropylene-polyethylene co-polymers, polyamides, polyesters, and polyurethane. Both oriented and unoriented filament are included. Also various filament cross-sections may be used such as for instance circular, lobular, trifoil, X and Y, triangular, polygonal, star-shaped, and the like. Mixtures of synthetic filaments may be employed in cases where the compositions of the filament are compatible during any fusing operation such as heat sealing. Such filaments may have suitable crimp imparted to their length or a portion thereof. Filaments may contain organic or inorganic modifications in order to make them bio-degradable, or self decomposing during or after use in a given period of time.

The term "picking" as used herein refers to the formation of filament tufts wherein two or more tufts are formed simultaneously by longitudinally engaging a plurality of cut-to-length filament at the ends and removing said filament simultaneously from a parallel disposed bundle of filaments. Picking devices employed are those of the types disclosed in my prior U.S Pat. Nos. 3,471,202; 3,910,637; 4,009,910 and 4,109,965, which are incorporated herein by reference.

The term "configured" refers to any dimensionally stable design; such as that of a pre-configured curved or flat, three dimensional blow-molded thermoplastic block after it has been fused into a brushware construction by the addition of synthetic filament tufts thereto.

The term "recyclable" as used herein refers to brushware made according to the instant invention wherein the block and tufts are made of the same chemically raw materials so that when the brushware is ground it can be reused and recycled. For example, a blow-molded polypropylene bottle having polypropylene tufts fused thereon.

Figure 1:
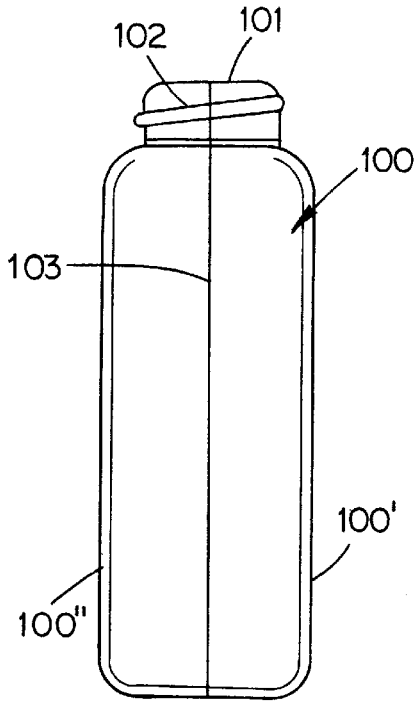
FIG. 1 (PRIOR ART)
FIG. 1 is a side view of an unassembled, conventional, blow-molded hollow container of the type to be used as a block member before fusing according to this invention.

With attention to the drawings, in particularly to FIG. 1, there is depicted a generic, conventional blow-molded polypropylene bottle 100 which has walls approximately 0.020 inches thick, and an open top with a threaded head portion 101 to accept a cap (not shown) a front flat wall 100' and a back flat wall 100". A parting line 103 running around the entire side wall and bottom of said bottle is shown also. This is intended to be a conventional representation and this invention is not intended to be limited to the type of molded construction used.

When the bottle 100 is fused with synthetic filament according to the process described in my above patents, a tuft of synthetic filaments has the non-working end fused and the outside surface of the bottle 100 is similarly heat softened. As is known to those skilled in the art this will open a hole in the outside surface of bottle 100 or cause the surface to distort because of the relatively thin wall thereof. If conventional thick brush block stock is used the tufted construction would be assembled according to the above identified, related patents.

Figure 2:
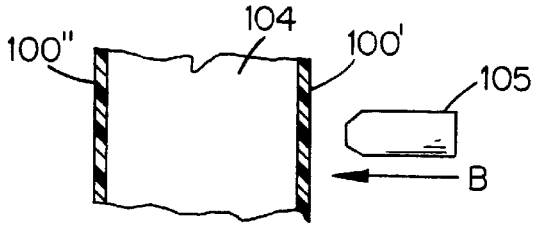
FIG. 2 (PRIOR ART)
FIG. 2 is a fragmentary schematic showing an attempt to heat-soften a surface for receiving a fused tuft on the bottle of FIG. 1.
Figure 3:
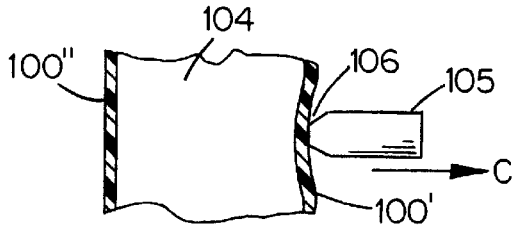
FIG. 3 (PRIOR ART)
FIG. 3 is a view similar to FIG. 2 showing heat directly applied to fuse the bottle surface.

With attention to FIG. 2, the bottle 100 defines a hollow interior 104. According to the process of my above patent, a heating means 105 is moved in the direction B toward the front surface 100. The melting means is normally at a temperature of at least about 700 Fahrenheit and this temperature is necessary in order to melt the surface 100' in about 1–2 seconds. As shown in FIG. 3, the melting means 105 causes a curvature 106 in surface 100', and after melting occurs the heating means 105 is translated backward in the direction C. While not shown, the heating means, if left adjacent to surface 100' a sufficient period of time, will not only melt the surface but open a hole there through, in addition to the distortion 106 shown in FIGS. 2–5.

Figure 4:
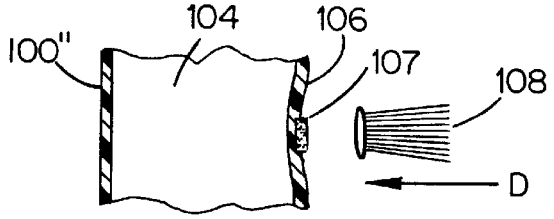
FIG. 4 (PRIOR ART)
FIG. 4 is a view similar to FIGS. 2 and 3 after the surface has been fused and prior to mounting the fused end of the tuft thereon.

Immediately after briefly heating the front surface 100', a fused filament tuft end 108 is indexed in the direction D onto the heated portion 107 of the curved wall 106 as shown in FIG. 4.

Figure 5:
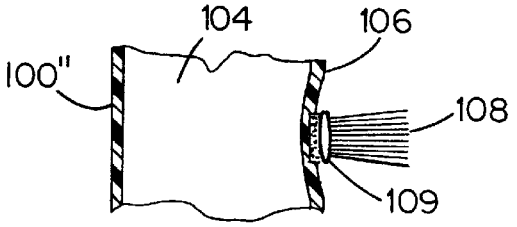
FIG. 5 (PRIOR ART)
FIG. 5 is a view similar to FIGS. 2–4 showing the fused tuft mounted on the surface of said container.

After allowing for sufficient cooling, i.e. about 4–5 seconds, the fused filament tuft as shown in FIG. 5 is fused at point 109 to the wall section 106 of the bottle 100. As shown however there is distortion left at the point of fusion. If multiple filament tufts are fused simultaneously on the thin wall member either (1) the entire surface will warp out of plane thus distorting the brush face and causing a collapse of the bottle inward, or (2) due to an excess amount of heat applied during the fusion process the actual surface will melt away and there will be no solid wall portion to which the fused tufts may be attached.

As shown then in FIGS. 2–5, if my prior art patented process is used with a relatively thin walled hollow structural base it may be possible to fuse tufts thereto, but the resultant products will not meet specifications, in all likely hood, the product will be a failure.

Figure 6:
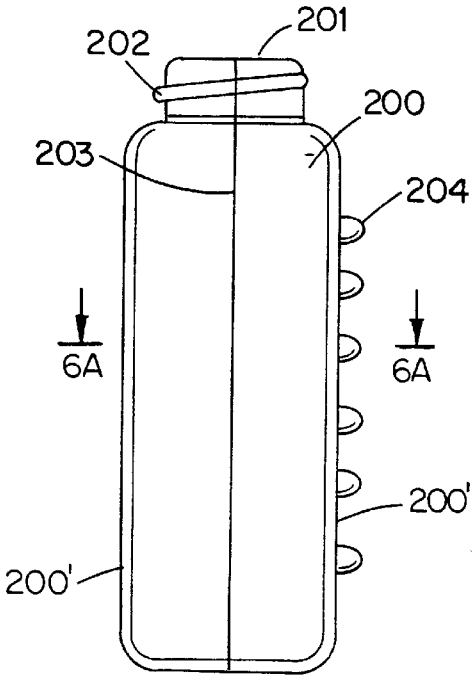
FIG. 6 is a view similar to FIG. 1 of a blow-molded hollow container having protrusions for mounting tufts thereon. according to this invention.

With attention to FIGS. 6–10, the modification of the instant invention can be seen for example in FIG. 6 wherein the hollow bottle 200 which has an open top 201 with threads 202 for accepting a closure or cap (not shown) front and back surface walls, 200' and 200" respectively at a parting line 203 running around the side walls and the bottom of bottle 200 and the improvement wherein the elongate side wall has molded protrusion 204 extending perpendicularly from the wall 200' which is intended to accept tufts to form the brushware construction. It should be noted that the wall thickness for the hollow base member most desirably is in the range of 0.020–0.050 inches consistent with the instant invention.

The improvement over the prior patented process described in the above of my patents is shown for example in FIGS. 7–10 wherein the previously molded conical protrusion 204 of wall 200' is heated with heating means 205 whereby the heating means is indexed in the direction E towards protrusion 204, and after melting the same retracted in direction F away from melt 204' to leave a fused layer 204" on a wall 200' where the protrusion 204 was originally molded. In this way a tuft 207 with a fused end can be indexed in the direction G onto the fused wall section 204".

The fused wall section 206 is a mass of plastic occupying a small area of the wall 200'. The thickness is from about 0.02–0.04" with a cross-sectional diameter of about 0.150". The fused mass 206 extends outwardly from the surface of the wall a distance of about 0.1000–0.150".

Figure 8:
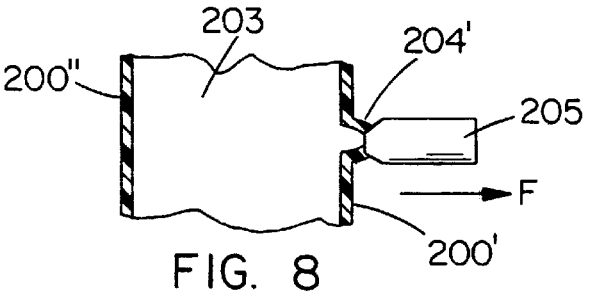
FIG. 8 is a view similar to FIG. 7 illustrating heat softening the protrusion thereon.

As the melter 205 (see FIG. 7) is indexed forward in the direction E the extended portion 204 of the front side wall 200' of the hollow bottle 200 will melt when it comes into contact with the heater 205. As shown in FIG. 8 this results in a melting portion of 204', and as it melts the melter means 205 is indexed away in the direction F.

Figure 9:
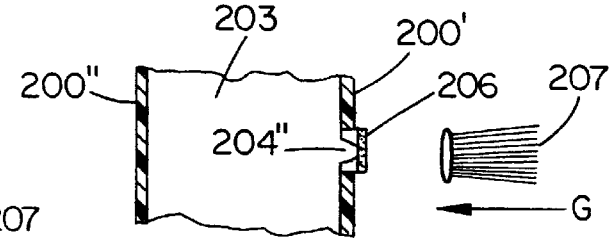
FIG. 9 is a view similar to FIG. 8 showing the fused base prior to receiving the fused tuft end.

With reference to FIG. 9, the melted portion 204' of FIG. 8 become liquid to semi-liquid whereby the actual front surface 200' has not yet become melted or deformed. This then forms a mass of plastic 206 which is fluid sufficient to fuse a tuft thereon. Note in FIG. 9, until the actual fusion takes place, there is a momentarily formed hollow section 204" behind the front wall 200". This melted mass 206 is still an integral portion of the original front wall 200'.

Figure 10:
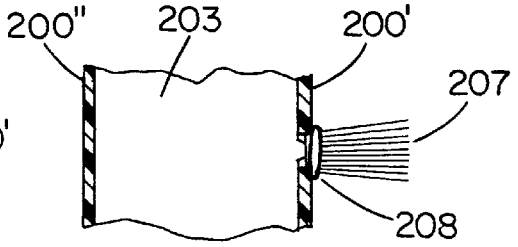
FIG. 10 is a view similar to FIGS. 7–9 showing the mounting of a fused tuft end on the container of FIG. 6.

As the melted fused filament tuft 207 of FIG. 9 is indexed forward in the direction G towards the mass of plastic 206 it becomes fused at point 208 as shown in FIG. 10. The tuft 207 is then integrally fused through the front surface 200' of the blow molded bottle 200 without heat distortion, open areas or other adverse features whereby the tuft 208 is integral with the bottle 200.

Figure 6A:
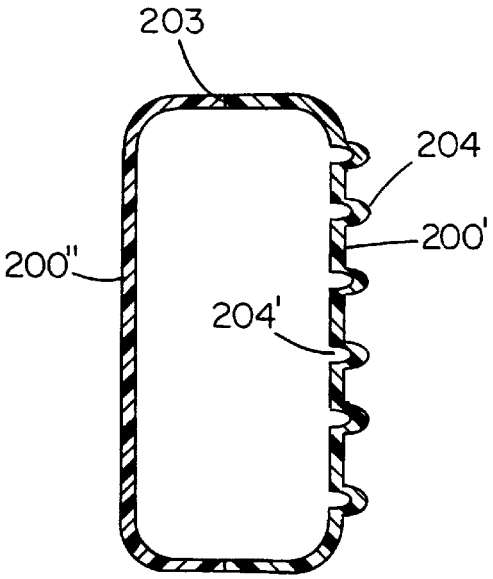
FIG. 6A is a cross-sectional view taken along lines 6A—6A FIG. 6.
Figure 7:
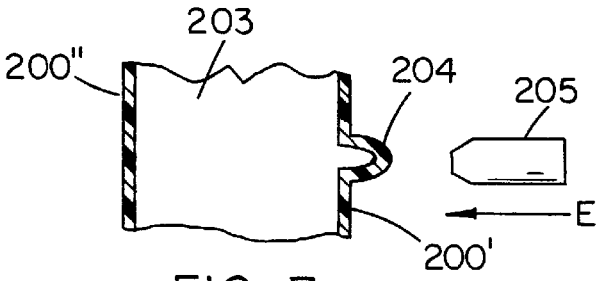
FIG. 7 is a fragmentary cross-sectional view of a portion of the container of FIG. 6 prior to heat softening the protrusion thereon.

As shown in FIG. 6*a,* in the preferred embodiment of this invention there is provided a multiple grouping of molded extending protrusions 204 at a predetermined surface location 200' where fused brush tufts 207 will ultimately will be fused thereon. These multiple protrusions 204 can be of various cross-sectional shapes, thickness', diameters, and the like and can be designed to accept different size and length fused filament tufts. The protrusions 204, however, are formed by molding and preferable by blow molding.

Figure 6B:
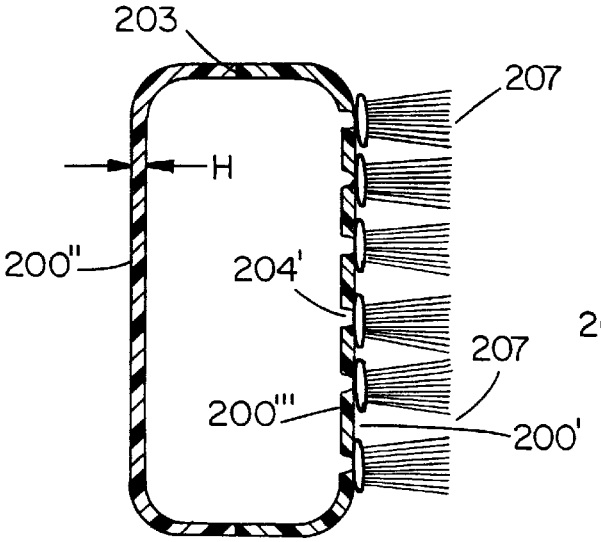
FIG. 6B is a view similar to FIG. 6A after the tufts have been mounted thereon.

With attention to FIG. 6*b,* there is not a visible distortion in the front wall surface 200' or on the inside surface wall portion 200'" prior to fusing. There is also provided no opening or openings in the outside wall from the internal hollow portion 204' after fusing. As shown at H, the wall thickness remains consistent throughout the front and back portions thereof 200' and 200", respectively. When blow molding is done with special methods, it is possible to maintain a consistent wall 200' in the front surface or tuft accepting area and at the same time thinning the back and side area of the bottle wall of thickness at H to something less while still keeping the integrity of the overall bottle. As will be obvious to those skilled in the art, this invention is not intended to be limited to wall of uniform thickness. The tuft accepting wall then may be 0.040 inches thick an the sides, bottom and back of the same bottle may have a thickness of only 0.020 inches.

Figure 11:
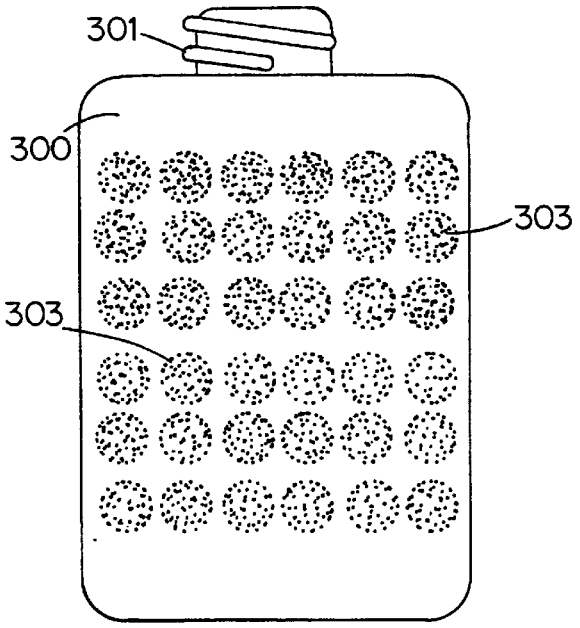
FIG. 11 is a front view of a tufted construction wherein tufts are integrally fused on the outside surface of a blow-molded hollow construction according to this invention.
Figure 12:
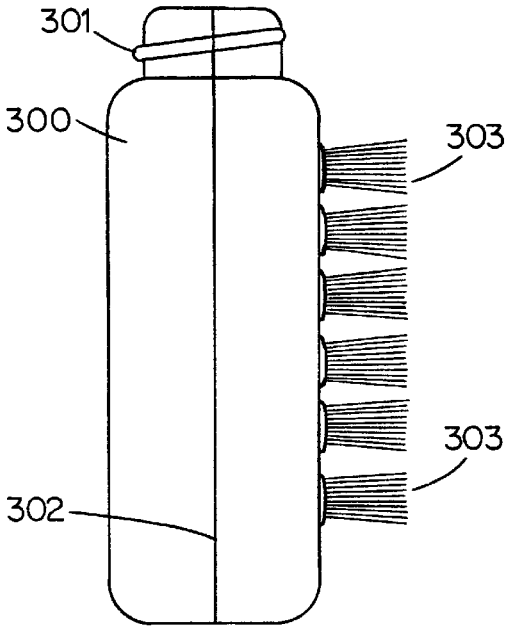
FIG. 12 is a side view of the device of FIG. 11.

FIGS. 11 and 12 illustrate one embodiment of a completed hollow blow molded polypropylene liquid dispensing brush unit of the instant invention wherein the bottle 300 is hollow and has a threaded open top portion 301 and a multiplicity of fused polypropylene filament tufts 303 extending integrally from one front surface. A parting line is shown located at 302. When the actual fused unit 300 is filled with, for example, a hygienic liquid soap solution and a dispensing cap (not shown) attached, the bottle becomes a hand held soap dispensing hand and nail scrub brush as one integral unit for use to sanitize one hands or other body areas.

Figure 13:
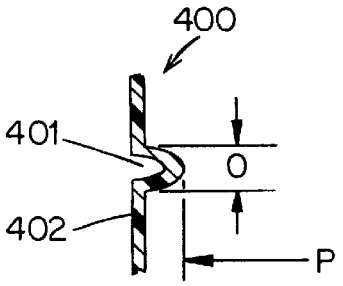
FIG. 13 is a fragmentary cross-sectional view of a single protrusion on the bottle of FIG. 6 illustrating the height-to-width ratio thereof.

It is important that the ratio of the extended protrusion of the surface to accept the fused filament tuft (see FIG. 13) be at least 0.4. This ratio is calculated by the height, P, of the outer surface protrusion 400 outwardly from the surface, and the diameter of the extended portion 401 at the base thereof Q. The wall thickness of the molded bottle must be in the range of 0.020"–0.050" with height P at least twice the thickness of the surface from which it extends.

The instant invention then is not limited to the above embodiment but variations from long, narrow handle type hollow units having fused filament constructions thereon to cleaning and dispensing chemical liquids or solid materials, to intricate 3-dimensional shapes are considered part of this invention.

It will be readily seen by one of ordinary skill in the art that the present invention fulfills all of the objects set forth above. After reading the foregoing specification, one of ordinary skill will be able to effect various changes, substitutions or equivalents and various other aspects of the invention as broadly disclosed herein. It is therefore intended that the protection granted hereon be limited only by the definition contained in the appended claims and equivalents thereof.

I claim:

1. A method for fabricating a tufted construction by fusing synthetic filament tufts onto the outer surface of a thin walled synthetic hollow container comprising:

providing a thin walled hollow container having a tuft receiving outer surface and a plurality of mutually spaced protrusions extending perpendicularly outwardly in a predetermined pattern;

providing a plurality of parallel cut-to-length synthetic filament tufts, each tuft having a thickness and a non-working end;

providing a source of heat and fusing the non-working ends of said tufts and the protrusions on said container therewith;

indexing the fused end of each tuft into a fused protrusion and allowing said fused tuft ends and protrusions to cool whereby said tufts are integrally attached to said container to form said tufted construction.

2. The method of claim 1 wherein said container is blow molded.

3. The method of claim 2 wherein said protrusions are hollow.

4. The method of claim 3 wherein the hollow container has a wall having a thickness of 0.020 to 0.050 inches.

5. The method of claim 3 wherein each protrusion, prior to fusing, has a ratio of height to width of at least 0.4.

6. The method of claim 3 wherein a height of each protrusion, prior to fusing, is a least twice the thickness of the surrounding container wall.

7. The method of claim 3 wherein each protrusion, prior to fusing, has a diameter about the thickness of each tuft.

8. The method of claim 3 wherein the step of fusing said protrusion includes heat softening said protrusion by heating an exterior thereof until it collapses into a solid molten plug in the outer surface of said container.

9. The method of claim 1 wherein said tufts and container are comprised of the same synthetic material.

10. The method of claim 1 wherein said container and protrusions are molded and said protrusions are hollow projections extending from the surface of said container, further comprising fusing said protrusions by heating the same until said protrusions collapse into a molten plug in the wall of said container.

* * * * *